United States Patent [19]

Floyd

[11] Patent Number: 4,890,518

[45] Date of Patent: Jan. 2, 1990

[54] HAMMER

[76] Inventor: Ted J. Floyd, 453 Grand Ave., Spring Valley, Calif. 92071

[21] Appl. No.: 364,855

[22] Filed: Jun. 12, 1989

[51] Int. Cl.[4] ..... B25D 1/00

[52] U.S. Cl. ..... 81/20; 254/26 R; 81/23

[58] Field of Search ..... 81/20, 23; 254/26 R

[56] References Cited

U.S. PATENT DOCUMENTS

| | | | |
|---|---|---|---|
| 1,411,567 | 4/1922 | Fisher | 81/23 X |
| 3,596,342 | 8/1971 | Willfurth | 81/20 X |
| 4,290,583 | 9/1981 | Lombardi | 81/20 X |

FOREIGN PATENT DOCUMENTS

| | | | |
|---|---|---|---|
| 228139 | 6/1963 | Austria | 81/20 |
| 2274407 | 1/1976 | France | 81/20 |

*Primary Examiner*—James G. Smith

*Attorney, Agent, or Firm*—Charles C. Logan, II

[57] ABSTRACT

A hammer having an improved head assembly. The hammer head assembly has a head portion, a shank portion, and a claw portion. The head portion has a front face having a triangular configuration. The head portion also has a horizontally oriented top wall and two side walls that converge downwardly toward their bottom ends where they meet. The center of the front face of the head portion lies on an axis that is perpendicular to the longitudinal axis of the handle and they intersect at the center of gravity of the hammer head assembly. The top end of the shank portion is flat so that the hammer can free stand on the surface. There is a rounded indentation between the shank portion and the claw portion so that it may be rested upon a block or cats paw for extra leverage. A T-shaped slot may be formed in the top end of the handle and it may have a related magnet for detachably capturing the head of a nail therein for hammering purposes.

10 Claims, 3 Drawing Sheets

HAMMER

BACKGROUND OF THE INVENTION

The invention relates to hammers and more specifically to novel structure that is incorporated into the hammer head assembly.

Conventional hammers having a metal head have existed for over a hundred years. Often these hammers have a claw portion for removing nails. There have been relatively few improvements in hammers in the last fifty years. The front face of the head of conventional hammers generally have a round configuration.

It is an object of the invention to provide an improved hammer having a head portion whose front face has a triangular configuration.

It is also an object of the invention to provide an improved hammer whose front face of its head portion has a center point that lies on the horizontal axis that passes through the center of gravity of the hammer head assembly.

It another object of the invention to provide an improved hammer having a head portion with a horizontally oriented top wall and two downwardly inwardly oriented side walls that meet at their bottom edge.

It is a further object of the invention to provide an improved hammer that has structure in the top end of the handle and shank portion of the hammer head assembly for magnetically gripping a nail while starting to hammer the same.

It is an additional object of the invention to provide an improved hammer having its top surface between the shank portion and the claw poriton to be used with a block or cats paw for extra leverage.

SUMMARY OF THE INVENTION

Applicant's novel improved hammer has been designed to allow it to be used in several ways not previously possible with conventional state of the art hammers. These new changes have been incorporate into the hammer head assembly which has a head portion, a shank portion, and a claw portion.

The head portion has a front face having a triangular configuration. It has a horizontally oriented top wall having downwardly converging side walls. The center of the front face of the head portion lies on a horizontal axis that passes through the center of gravity of the hammer head assembly and this center of gravity is in the shank portion. Also passing through the center of gravity is the longitudinal axis extending upwardly through the handle of the hammer. The front face of the head portion is also substantially parallel to the longitudinal axis of the handle. The shape of the front face of the head portion saves thumbs when starting nails. The fact that the front face of the head portion is substantially parallel to the longitudinal axis of the handle functions to keep the hand safely away from surfaces during the hammering motion.

The shank portion has a top end that is substantially flat and also perpendicular to the longitudinal axis of the handle. Since the top wall surface of the head portion and the top surface of the claw portion do not extend above the top flat surface of the shank portion, the hammer can free stand on this surface. The height of the shank portion from top to bottom has been lengthened to help prevent handle breakage. The shank is also tapered from the top to bottom on its side surfaces at approximately 4 degrees. A rounded indentation is formed along the top surface of the shank portion where it meets the claw portion to provide a secure area for use of a block or cats paw for extra leverage when pulling nails out. The flat top wall surface of the head portion also provides better leverage since the top of the hammer will not rock laterally due to its flat surface.

The top wall of the head portion has a width at its front end that narrows to the width of the shank portion. The angle involved from each of the sides is approximately 2½ degrees. The claw portion at its rear end has a width substantially the same as the width at the front end of the head portion. The claw portion narrows in width from rear to front at approximately 2½ degrees on each of its side surfaces.

DESCRIPTION OF THE PREFERRED EMBODIMENT

Figure 1:
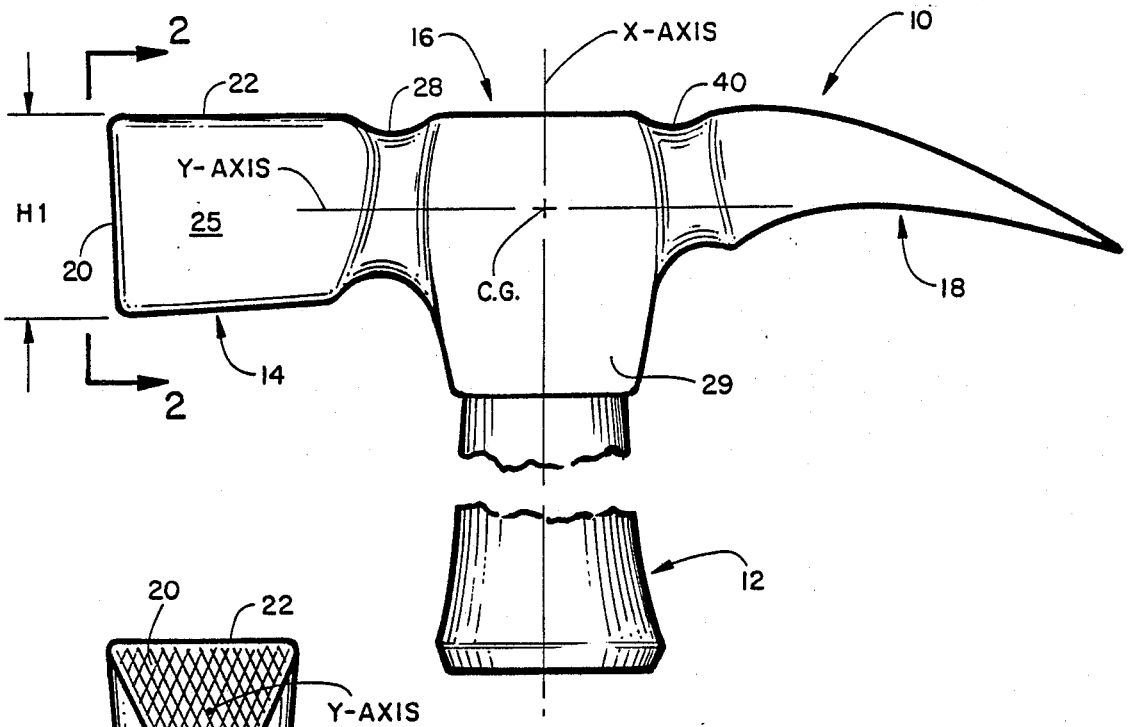
FIG. 1 is a side elevation view of applicant's novel improved hammer with the length of the handle depicted in broken away form.
Figure 2:
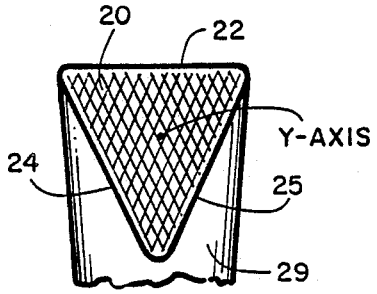
FIG. 2 is a front elevation view of the front face of the head portion.
Figure 3:
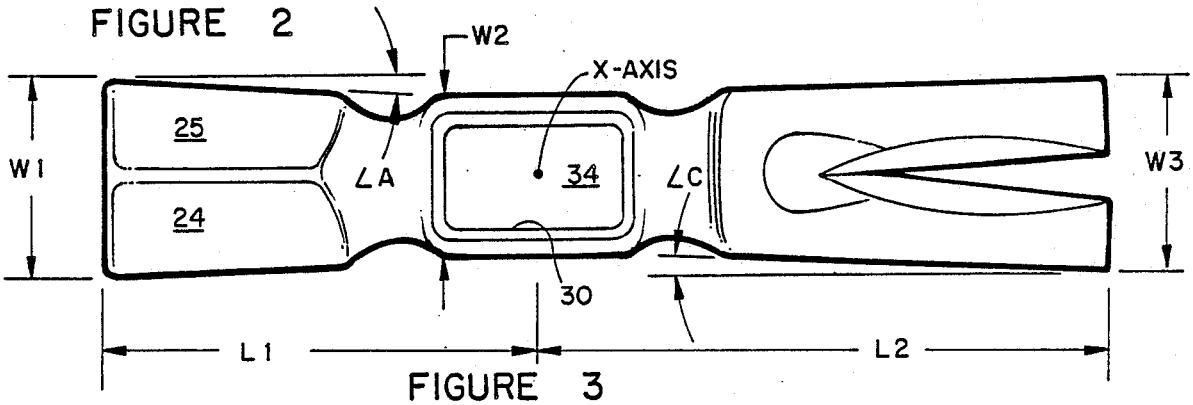
FIG. 3 is a top plan view of the hammer head assembly.
Figure 4:
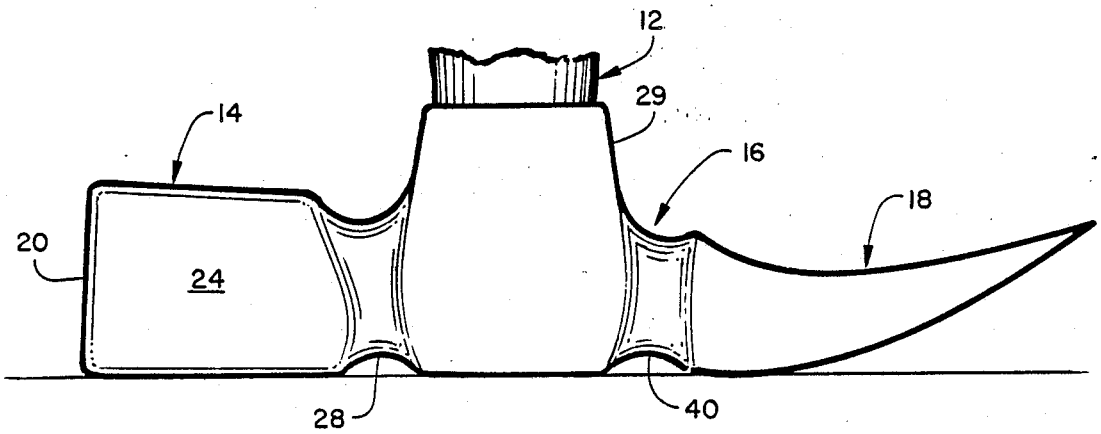
FIG. 4 is a side elevation view of the hammer in its inverted position.

Applicant's novel hammer will now be described by referring to FIGS. 1–7 of the drawings. The hammer head assembly is generally designated numeral 10 and the handle numeral 12.

Hammer head assembly 10 has a head portion 14, a shank portion 16, and a claw portion 18. The center of gravity (c.g.) of the hammer head assembly is located on the longitudinally extending x-axis of the handle where it intersects with the y-axis passing through the center of the front face of the head portion.

Head portion 14 has a front face 20 having a triangular configuration. It also has a top wall 22 and downwardly converging side walls 24 and 25. An annular indentation 28 is formed where head portion 14 meets shank portion 16. The width W1 at the front edge of top wall 22 narrows from each of its sides at an angle A to a width W2 at the front edge of shank portion 16. Shank portion 16 has a downwardly extending neck 28 having a bore 30 into which is telescopically received the top end 34 of handle 12. The side walls 36 and 37 of shank portion 16 converge downwardly to the bottom edge of neck 29 at an angle B.

At the forward edge of claw portion 18 where it meets the rear edge of shank portion 16, an annular rounded indentation 40 is formed. A nail groove 42 is formed in the rear of claw portion 18. The rear end of claw portion 18 has a width W3 that narrows to a width W2 at the rear edge of shank portion 16. The angle of narrowing is angle C from each of the lateral sides of claw portion 18.

The distance from the front face 20 to the center of gravity is L1 and the distance from the center of gravity to the rear edge of claw portion 18 is L2. L2 is longer than L1 due to the larger mass in the head portion 14.

Figure 5:
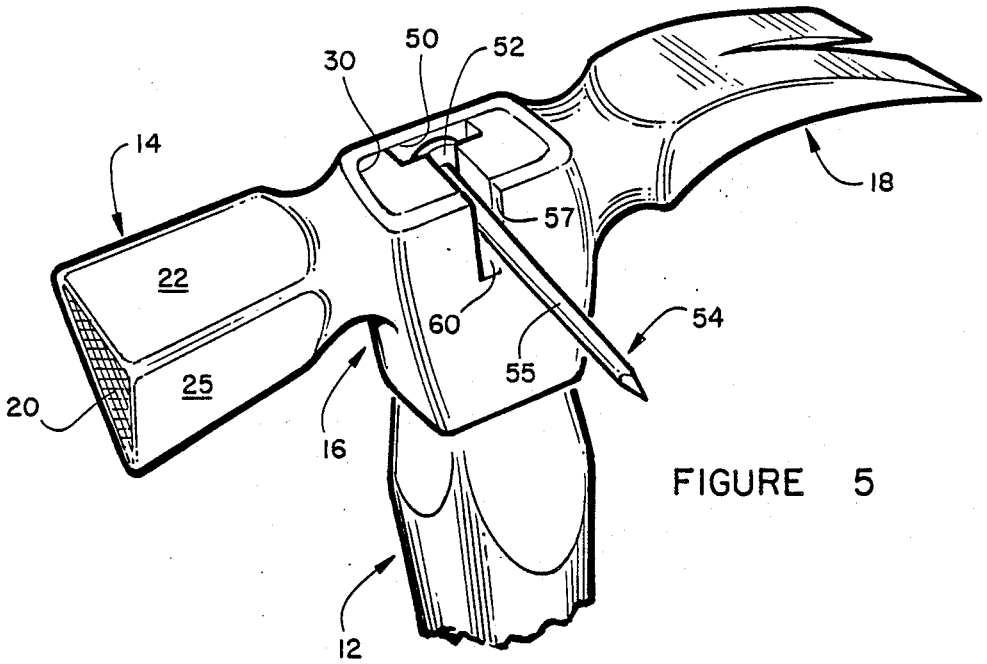
FIG. 5 is a perspective view of the improved hammer having an alternative magnetic nail starting structure.

In FIG. 5, an alternative structures is illustrated in the hammer head assembly. A T-shaped slot 50 is formed in the top end of handle 12 for receiving the head 52 of a nail 54. The shank 55 of nail 54 passes through a slot 57 in the side wall of shank portion 16. A magnet 60 is located in the side wall of shank portion 16.

Figure 6:
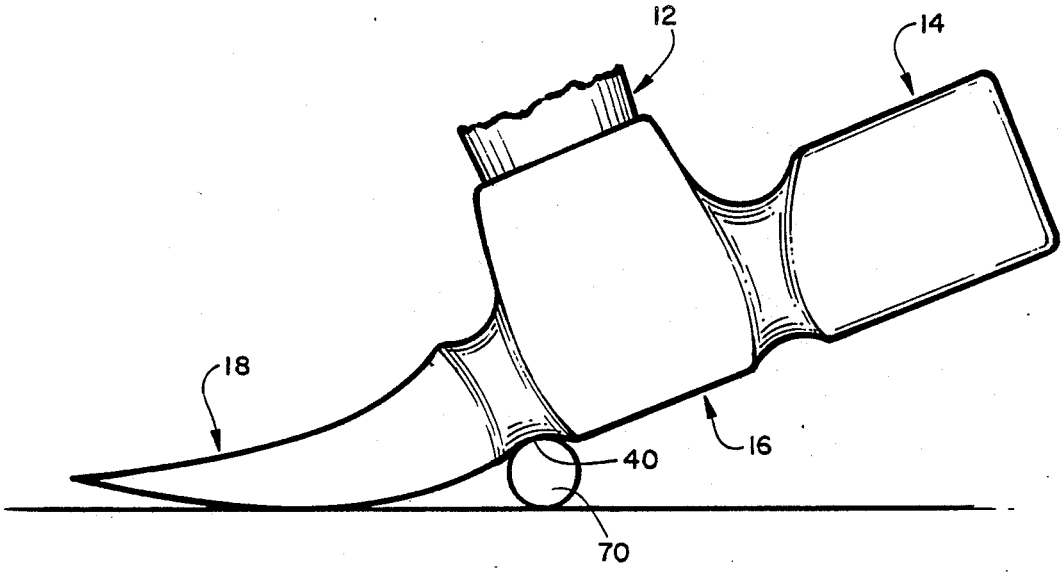
FIG. 6 is a side elevation view illustrating the manner in which the hammer head assembly is used with a cats paw.
Figure 7:
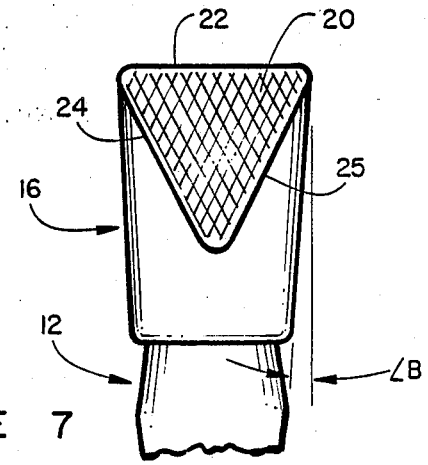
FIG. 7 is a cross sectional view taken along line 7—7 of FIG. 1.
Figure 8:
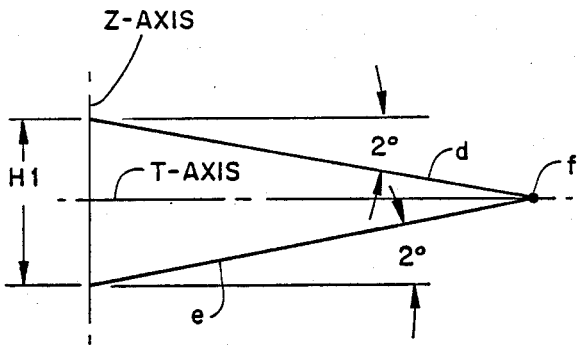
FIGS. 8–13 are schematic drawings illustrating how the top and bottom curvatures of the claw portion are determined.

In FIG. 6, the hammer is illustrated in the position used for prying boards apart or prying out nails. A cats paw 70 is shown positioned under annular rounded indentation 40 where it is firmly positioned to give increased leverage. In designing the curvature of the claw portion for hammers having different heights H1, the process illustrated in FIGS. 8–13 is used. The first step is to determine just what height one wants to make the front face of the head portion. This dimension is marked off on a vertical z-axis. Next lines d and e are drawn at a 2 degree angle to the z-axis from both the top and bottom of dimension H1. These lines are extended until they intersect at point f. A horizontal t-axis is then drawn to bisect the triangle that has been created.

Figure 9:
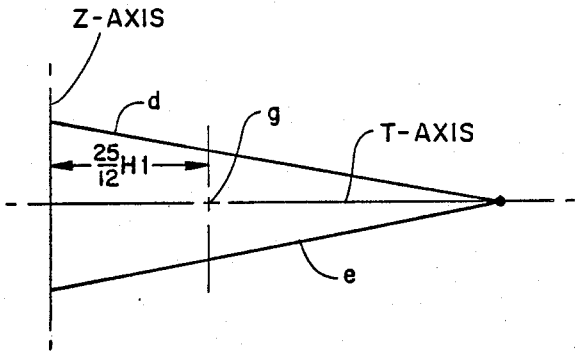
Figure 10:
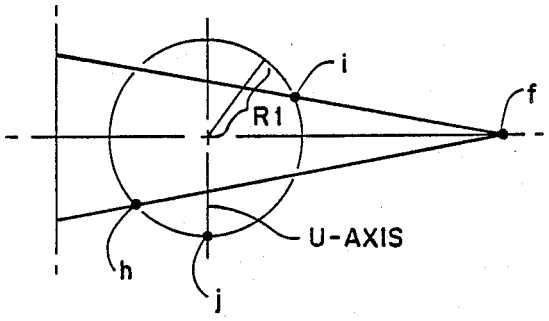
Figure 11:
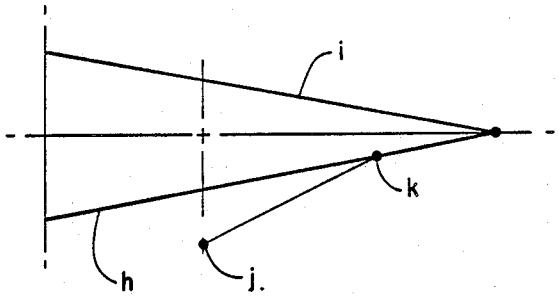

Moving to FIG. 9, a constant K1, which is equal to 25/12 is multiplied by H1 and this is measured along the t-axis to identify point g. In FIG. 10 a constant radius R2, which equals 6/5 H1, is used to describe a circle about point g. This circle intersects the triangle at points h and i and also a vertical u-axis at point j. A line is drawn between points h and i and then a parallel line to that is drawn from point j and it intersects the triangle to locate a point k.

Figure 12:
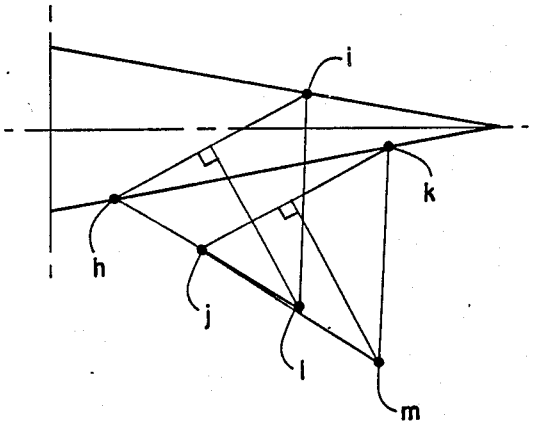
Figure 13:
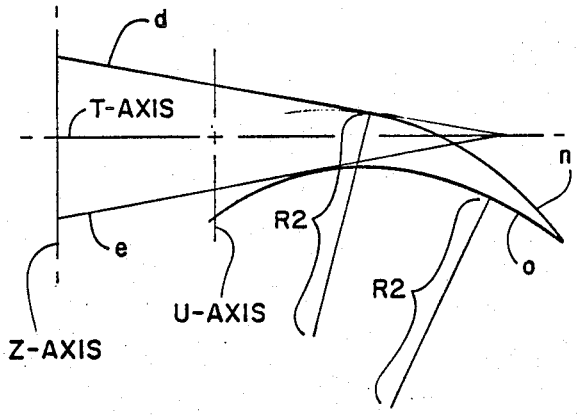

In FIG. 12, equilateral triangles are drawn using lines h, i and j, k as one side of these triangles. The length of each of these sides in $9/4 \times$ H1 and they identify points l and m. Using the radius R2 which is equal to $9.4 \times$ pk H1, the arcs n and o are drawn and these represent the top and bottom curvatures of the claw of the hammer.

What is claimed is:

1. An improved hammer comprising:

an elongated handle having a longitudinally extending x-axis, said handle having a top end and a bottom end;

a hammer head assembly having a head portion, a shank portion and a claw portion; and said head portion having a front face having a triangular configuration, said front face having a substantially flat surface that lays in a vertical plane that is parallel to the x-axis of said handle, said head portion having a top wall and two side walls that meet at their bottom end, the center point of said front face lays on a horizontal y-axis that intersects said x-axis at substantially the center of gravity of said hammer head assembly.

2. An improved hammer as recited in claim 1 wherein the top wall of said head portion has a substantially flat surface.

3. An improved hammer as recited in claim 2 wherein the side walls of said head portion have a substantially flat surface.

4. An improved hammer as recited in claim 2 wherein said head portion has a top end that is substantially flat so that said hammer can free stand on this surface.

5. An improved hammer as recited in claim 4 wherein the front end of said top wall of said head portion has a width W1, the top end of said shank portion having a width W2 that is less than W1 by a predetermined amount.

6. An improved hammer as recited in claim 5 wherein said claw portion has a rear end having a width W3 and W3 is greater than W2 by a predetermined amount.

7. An improved hammer as recited in claim 6 wherein width W1 is substantially the same as width W3.

8. An improved hammer as recited in claim 1 wherein the distance from the front face to the center of gravity of said hammer head assembly is L1, the distance from the rear end of said claw portion to said center of gravity is L2 and L2 is greater than L1 by a predetermined amount.

9. An improved hammer as recited in claim 2 further comprising a rounded indentation formed in the top wall of aid head portion where it meets said shank portion.

10. An improved hammer as recited in claim 1 further comprising a T-shaped slot formed in the top wall of said shank portion for removably receiving the head of a nail so that it may be captured therein.

* * * * *